US006770320B2

(12) United States Patent
Yamauchi et al.

(10) Patent No.: US 6,770,320 B2
(45) Date of Patent: Aug. 3, 2004

(54) APPARATUS AND METHOD FOR APPLYING FLUID

(75) Inventors: Hiroshi Yamauchi, Katano (JP); Hidenobu Nishikawa, Ikoma (JP); Takashi Sonoda, Ritto (JP); Teruo Maruyama, Hirakata (JP); Shuji Ono, Kobe (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/207,184

(22) Filed: Jul. 30, 2002

(65) Prior Publication Data

US 2003/0084844 A1 May 8, 2003

(30) Foreign Application Priority Data

Aug. 3, 2001 (JP) ..... 2001-236413

(51) Int. Cl.[7] ..... B05D 1/26

(52) U.S. Cl. ..... 427/8; 118/677; 118/681; 118/684; 118/704; 222/56; 239/95

(58) Field of Search ..... 118/683, 677, 118/704, 669, 679, 681, 684; 222/56; 427/8, 9, 10; 239/95, 88; 425/421

(56) References Cited

U.S. PATENT DOCUMENTS 5,553,742 A * 9/1996 Maruyama et al. ..... 222/1
5,932,012 A * 8/1999 Ishida et al. ..... 118/669

FOREIGN PATENT DOCUMENTS

| | | |
|---|---|---|
| JP | 2002-102768 | 4/2002 |
| JP | 2002-102770 | 4/2002 |
| JP | 2002-143745 | 5/2002 |

* cited by examiner

*Primary Examiner*—Richard Crispino
*Assistant Examiner*—George R. Koch, III
(74) *Attorney, Agent, or Firm*—Wenderoth, Lind & Ponack, L.L.P.

(57) ABSTRACT

An apparatus and a method for applying a fluid, which enable an application amount of the fluid to be stabilized even at the start of fluid discharge and at the end of the fluid discharge. The apparatus includes an application head and a control unit, whereby operational control is carried out so that a discharge member is rotated and moved in a discharge direction along an axial direction of the discharge member when the fluid is to be discharged, while the rotation of the discharge member is stopped and the discharge member is moved in a direction opposite to the discharge direction when the discharge is to be stopped. The application amount of the fluid to be applied can be stabilized even at the start of fluid discharge and at the end of the fluid discharge.

4 Claims, 7 Drawing Sheets

APPLICATION DIRECTION
332
334
336

APPLICATION SHAPE
331
333

FLUID PRESSURE
335
337

ON
OFF
DISCHARGE OPERATION
338

MOVEMENT
STOP
X,Y-MOVEMENT

APPLICATION DIRECTION
30
31
32

APPLICATION SHAPE

FLUID PRESSURE

ON
OFF
DISCHARGE OPERATION

MOVEMENT STOP
X,Y-MOVEMENT

APPARATUS AND METHOD FOR APPLYING FLUID

BACKGROUND OF THE INVENTION

1. Field of the Invention

The present invention relates to an apparatus and a method for applying a fluid which can be used in a production process of electronic components, household electrical appliances, etc. for discharging a constant amount of various kinds of liquid such as adhesives, solder paste, phosphors, grease, paint, hot melt, medicines, foods, etc.

2. Description of the Related Art

While a liquid discharge apparatus (dispenser) has been conventionally used in a variety of fields, a technique of highly accurately and stably controlling to discharge a minute amount of fluid material becomes required in accordance with the current need for electronic components to be made compact with a high recording density. In the field of, for example, a surface mounting technique (SMT) for electronic components, high-speed, high-density, high-quality and automatic mounting into a micro-size is required and, the contents of the requirement to the dispenser are summarized as follows:

(1) To obtain a highly accurate application amount while holding the application amount for each time minute;

(2) To shorten a discharge time, i.e., to discharge, shut and start the discharge at high speeds; and (3) To meet highly viscous fluids in powders.

In order to discharge a liquid of a minute flow rate, dispensers of an air pulse system, a groove type, and the like have been practically used heretofore.

Among the dispensers of the aforementioned types, the dispenser of the air pulse system as indicated in FIG. 8 has been widely employed. The dispenser of this system supplies a constant amount of the air supplied from a constant pressure source 20 into a cylindrical container 10 in pulses, thereby discharging a constant amount of a liquid 25,corresponding to an amount of a pressure rise in the container 10 through a nozzle 12.

The dispenser of the air pulse system is poorly responsive when discharging the fluid 25. Meanwhile, a screw type dispenser, such as a viscous pump, has also been put in practical use. The dispenser of this type generally adopts a structure wherein an object to which the liquid or the like is to be applied by the dispenser, and the dispenser are made relatively movable in X, Y and Z directions, so that the liquid can be applied linearly by moving the object to be applied and the dispenser relatively in either the X or the Y direction while discharging the liquid from the dispenser.

In the above-described conventional application method, as is apparent from FIGS. 9C and 9D, a discharge control signal for letting the dispenser carry out a discharge operation is set to rise and fall with the same timing as a timing of a rising edge and a falling edge of a movement control signal for moving the dispenser and the object to be applied in the X or Y direction. It takes a predetermined amount of time before a constant amount of the fluid is discharged after the discharge control signal is supplied in the above dispenser, as is shown in FIG. 9D. Similarly, it takes a predetermined period of time before the fluid discharge is actually stopped after a signal instructing stopping the discharge is supplied. Therefore, an application state of the fluid from the dispenser to the object to be applied becomes one such as is represented in FIG. 9A. Specifically, the application starts at an application start part 30 with the time delay from the rise of the discharge control signal, having an application amount gradually increased, whereas the fluid is turned to a mass shaped at a discharge termination part 32 because of the application amount being amassed by the time difference between the signal and the actual discharge stop. In other words, as indicated by a dotted line in FIG. 9A, it is difficult for the conventional fluid application apparatus to form a fixed fluid application region and obtain a uniform application amount over an entire range of the fluid application region. The reason for this is that starting and stopping the discharge of the fluid having fluidity is subject to a time lag, while moving the object to be applied and the dispenser in the X or Y direction is a mechanical operation without a time lag. Although, for example, an operation timer can be set to delay the movement in the X or Y direction, to stop the discharge earlier, etc. for solving the above problem and obtaining a normal application state, it is difficult to match the fluid discharge with the mechanical operation particularly in the case of a fluid which is viscous, and consequently the application state still varies.

In the field of forming circuits which increasingly becomes highly accurate and superfine; and in the fields of manufacturing processes of forming electrodes and ribs of image tubes such as PDPs (plasma display panels), CRTs, etc., applying a sealing material of liquid crystal panels, and manufacturing optical discs or the like; the following requirements are made in relation to a fine application technique:

(1) To be able to quickly stop the application after continuous application and to immediately restart the continuous application a short time later. It is ideal to control a flow rate in the order of, for example, a 0.01 second; and (2) To be able to meet fluids in powders, for example, without crushing and breaking the powder, clogging a channel, or the like trouble by mechanically shutting the channel.

SUMMARY OF THE INVENTION

An object of the present invention is therefore to provide an apparatus and a method for applying a fluid, while eliminating the above-described problems, whereby an application amount of the fluid to be applied can be kept stable even at a fluid discharge start part and a fluid discharge termination part.

In order to accomplish the above objective, the present invention has following constructions.

According to a first aspect of the present invention, a fluid application apparatus, which is provided with an application head including:

a cylindrical discharge member for carrying out a discharge operation for a fluid to be applied;

a storage member shaped like a recess for storing the discharge member via a first gap in a diametrical direction of the discharge member and a second gap in an axial direction of the discharge member, having a discharge passage extending along a center axis of the discharge member to be opened to the second gap for discharging the fluid supplied to the first gap and moved to the second gap to the outside;

a moving device having an electro-magnetostrictive element for controlling starting and stopping the discharge of the fluid through the discharge passage to the outside by moving the discharge member along the axial direction;

a rotating device for rotating the discharge member along a circumferential direction of the discharge member; and a movement groove formed to at least either a circumferential face of the discharge member facing the first gap or a first opposite face opposite to the circumferential face of the storage member for moving the fluid present at the first gap to the second gap by the rotation of the discharge member by the rotating device, and a control unit connected to the moving device and the rotating device for carrying out to the moving device an operational control of moving the discharge member in a discharge direction along the axial direction when the fluid is to be discharged through the discharge passage to the outside.

The control unit can also control the rotating device to rotate the discharge member when the fluid is to be discharged through the discharge passage to the outside.

The above control unit can further control the rotating device so as to stop the rotation of the discharge member, and at the same time, control the moving device so as to move the discharge member in a direction opposite to the discharge direction along the axial direction when the fluid discharge through the discharge passage is to be stopped.

The fluid application apparatus can be further provided with a supporting member for supporting an object to which the fluid is to be applied by the application head, a lift device for relatively moving the application head and the supporting member up and down, and a horizontal moving device for relatively moving the application head and the supporting member in a horizontal direction orthogonal to the lifting direction by the lift device. In a fluid application operation from the application head to the object to be applied, after the control unit makes the lift device relatively move the application head and the supporting member up and down to be close to each other, at a fluid discharge start time, the control unit executes operational controls to the rotating device and the moving device of starting the rotating the discharge member and the moving the discharge member in the discharge direction, and at the same time an operational control to the horizontal moving device of starting the relatively moving the application head and the supporting member in the horizontal direction; until the fluid discharge through the discharge passage is stopped after the discharge start, the control unit executes an operational control to the rotating device of the rotating the discharge member and an operational control to the horizontal moving device of the moving the application head and the supporting member; and at a stop time of the fluid discharge, the control unit executes an operational control to the rotating device of stopping the rotating the discharge member, an operational control to the moving device of stopping the moving the discharge member, and at the same time an operational control to the horizontal moving device of stopping the relatively moving the application head and the supporting member in the horizontal direction as well as an operational control to the lift device of relatively moving the application head and the supporting member up and down to separate from each other.

According to a second aspect of the present invention, there is provided a fluid application method carried out with the use of an application head which includes a cylindrical discharge member for carrying out a discharge operation for a fluid to be applied;

a storage member shaped like a recess for storing the discharge member via a first gap in a diametrical direction of the discharge member and a second gap in an axial direction of the discharge member, having a discharge passage extending along a center axis of the discharge member to be opened to the second gap for discharging the fluid supplied to the first gap and moved to the second gap to the outside;

a moving device having an electro-magnetostrictive element for controlling starting and stopping the discharge of the fluid through the discharge passage to the outside by moving the discharge member along the axial direction;

a rotating device for rotating the discharge member along a circumferential direction of the discharge member; and a movement groove formed to at least either a circumferential face of the discharge member facing the first gap or a first opposite face opposite to the circumferential face of the storage member for moving the fluid present at the first gap to the second gap by the rotation of the discharge member by the rotating device, the method comprising:

moving the discharge member in a discharge direction along the axial direction when the fluid is to be discharged through the discharge passage to the outside.

In the above-described fluid application method of the second aspect, the discharge member can be rotated, and moreover moved in the discharge direction when the fluid is to be discharged through the discharge passage to the outside, while the rotation of the discharge member is stopped and the discharge member can also be moved in a direction opposite to the discharge direction along the axial direction when the fluid discharge from the discharge passage is to be stopped.

Further, the fluid application method of the second aspect enables an operation control, whereby, when application from the application head to an object to which the fluid is to be applied by the application head is to be carried out, after the application head and the object to be applied are relatively moved to be close to each other, at a fluid discharge start time, the rotation of the discharge member and the movement of the discharge member in the discharge direction are started, and at the same time, the application head and the object to be applied are started to be relatively moved in a horizontal direction; before a stop of the fluid discharge through the discharge passage after the discharge start, the rotating the discharge member and, the moving the application head and the supporting member are carried out; and at a stop time of the fluid discharge, the rotating the discharge member is stopped, the moving the discharge member is stopped, and at the same time an operational control of stopping the relative movement of the application head and the object to be applied in the horizontal direction as well as relatively moving the application head and the object to be applied up and down to separate from each other is carried out.

According to the fluid application apparatus of the first aspect and the fluid application method of the second aspect of the present invention, there are provided the application head and the control unit, so that the operation is controlled to move the discharge member in the discharge direction along the axial direction when the fluid is to be discharged. By adopting the above arrangement, the fluid application apparatus having the moving device including the electro-magnetostrictive element to the application head is enabled to control the fluid discharge, that is, temporarily increase a discharge amount of the fluid at a fluid discharge start part.

When the fluid is to be discharged, the control unit may control rotation of the discharge member and also move the discharge member in the discharge direction along the axial direction. This arrangement enables the fluid to be supplied to the discharge member through the rotation of the discharge member, thereby the fluid being able to be discharged more smoothly.

When the discharge is to be stopped, the control unit controls to stop the rotation of the discharge member and move the discharge member in the opposite direction to the discharge direction. Because of the above arrangement, it becomes possible to temporarily increase the discharge amount of the fluid at the fluid discharge start part, and suppress the fluid so as not become stringy and prevent an application amount from increasing at a fluid discharge end part. The application amount of the fluid can be stabilized both at the fluid discharge start part and the fluid discharge end part.

There are also provided the lift device and the horizontal moving device, thereby moving the object to be applied in the horizontal direction in correspondence to the fluid discharge start operation and the fluid discharge termination operation by the discharge member. The application amount of the fluid to be applied to the object to be applied is accordingly stabilized even at the fluid discharge start part and the fluid discharge end part.

BRIEF DESCRIPTION OF THE DRAWINGS

These and other objects and features of the present invention will become clear from the following description taken in conjunction with the preferred embodiment thereof with reference to the accompanying drawings in which.

DETAILED DESCRIPTION OF THE PREFERRED EMBODIMENTS

Figure 1:
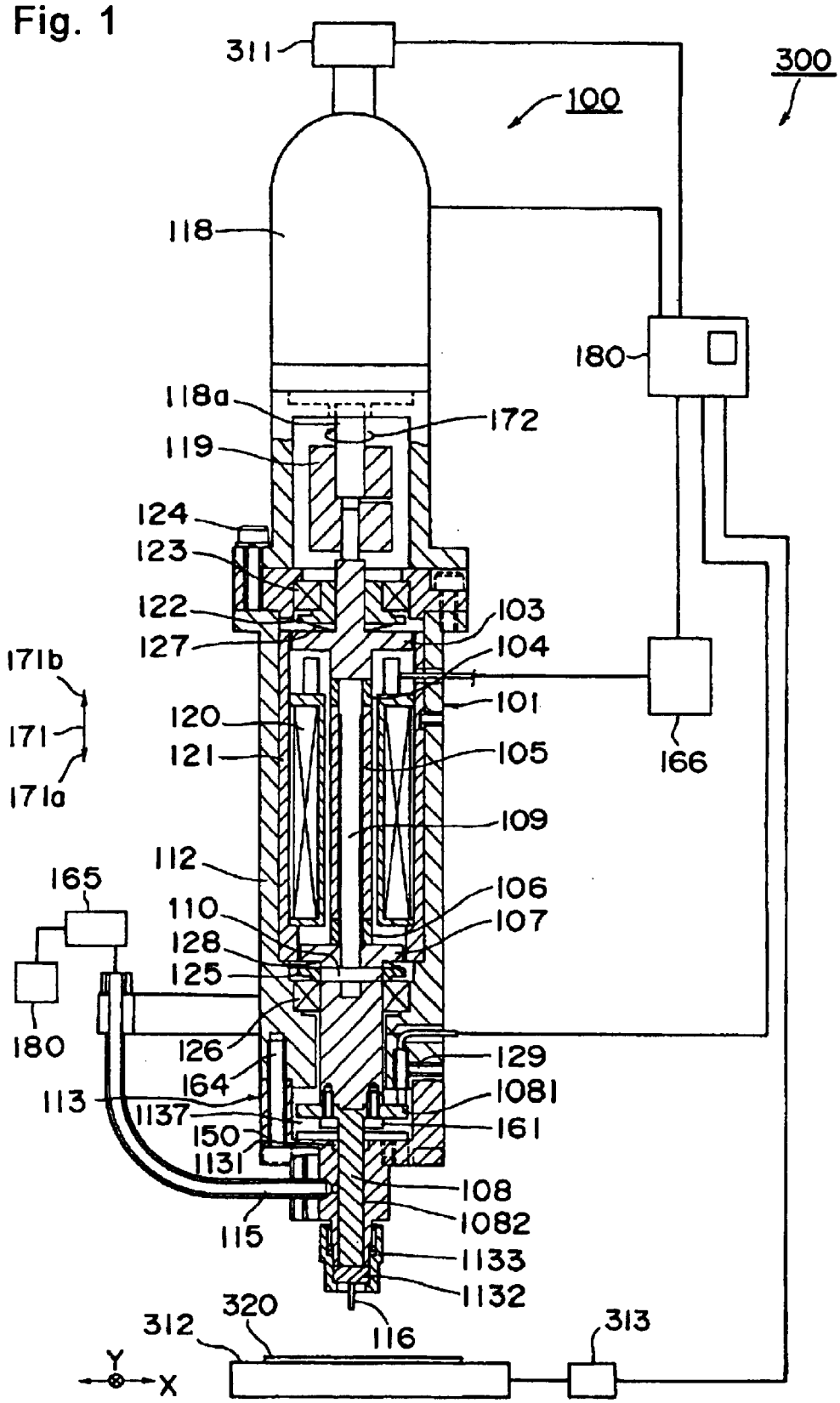
FIG. 1 is a diagram showing a configuration of a fluid application apparatus according to an embodiment of the present invention.

A fluid application apparatus and a fluid application method carried out by the fluid application apparatus which are embodiments of the present invention will be described below with reference to the attached drawings throughout which like parts are designated by like reference numerals. The fluid application apparatus of the present invention is exemplified as is used in a field of mounting electronic components on circuit formation objects. Therefore, a fluid to be applied by the apparatus is a material for fixing, that is, a generally named adhesive for fixing electronic components to substrates, connecting electrodes of electronic components to electrodes of substrates, connecting wired substrates with each other, connecting wired substrates to LCDs, etc. However, the fluid application apparatus is not limited to the above mounting field and the above fluid, and is applicable, e.g., to various kinds of fluid in the fields of medicines, foods and the like.

FIG. 1 shows a fluid application apparatus 300 constructed in accordance with the preferred embodiment of the present invention. The fluid application apparatus 300 comprises an application head 100 for discharging a fluid, and a control unit 180. The apparatus can also comprise a lifting device 311, a supporting member 312 for an object on which the fluid is to be applied, and a horizontal moving device 313.

Figure 2:
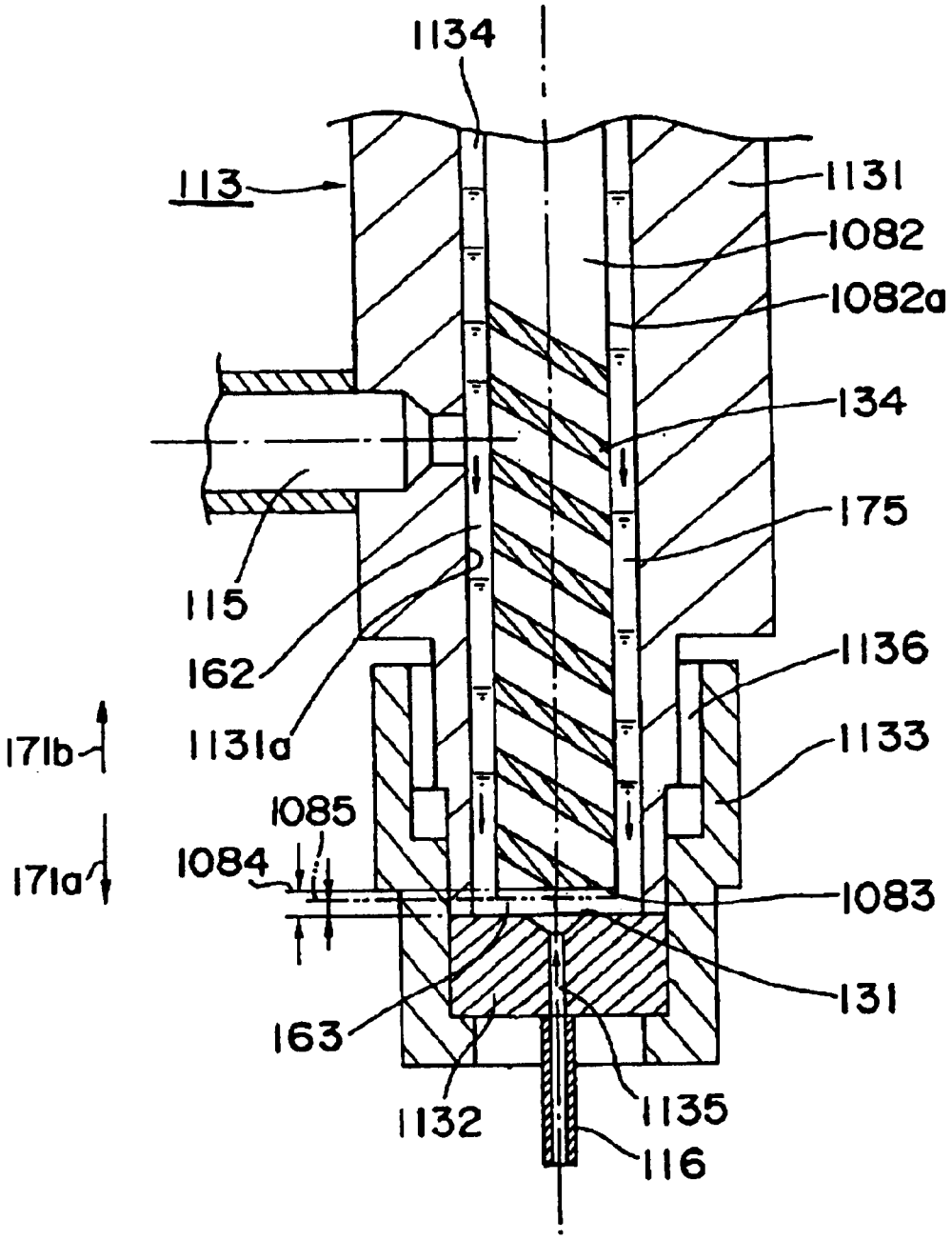
FIG. 2 is an enlarged view of a discharge member part of an application head shown in FIG. 1.

The application head 100 will be described in the first place. The application head 100 can have, as essential parts constituting the application head, a cylindrical discharge member 108, a storage member 113 in which the discharge member 108 is stored via a gap and to which a discharge passage for discharging the fluid to be applied is formed, a moving device 101 for moving the discharge member 108 in its axial direction, a rotating device 118 for rotating the discharge member 108 in its circumferential direction, and a movement groove 134 formed to a circumferential face of the discharge member 108 as shown in FIG. 2.

As is clear from FIG. 1, the application head 100, which roughly includes the above-described parts, has a construction in which the rotating device 118, a housing 112 of the moving device 101 and the storage member 113 are arranged coaxially in this order. In the application head 100, the fluid to be applied is supplied into the gap formed by the storage member 113 and the discharge member 108, and is controlled so as to be discharged by the rotation of the discharge member 108 by the rotating device 118 and by the movement of the discharge member 108 in the axial direction by the moving device 101, so that an application amount of the fluid is stabilized even at the start of fluid discharge and at the end of the fluid discharge. The structure and the operation of the application head 100 will be fully described below.

First, the moving device 101 will be described. In order to quickly and intermittently supply a fluid having a high viscosity in a minute amount and with a high degree of accuracy, according to the present embodiment, the moving device 101 uses as a driving source, a super magnetostriction rod 105 with a super magnetostrictive element which can obtain a high positioning accuracy for a member to be moved, has a high responsiveness, and can generate a large load. The super magnetostrictive element is used as an example functioning as electro-magnetostrictive elements in the embodiment.

The moving device 101 includes a rear side yoke103, a rear side permanent magnet 104, the super magnetostriction rod 105, a front side permanent magnet 106, a front side yoke 107, a magnetic field coil 120, a yoke material 121 and the housing 112. More specifically, as indicated in FIG. 1, the loop-shaped magnetic field coil 120 is mounted to the yoke material 121 attached to an inner wall of the housing 112 inside the hollow housing 112, and the loop-shaped super magnetostriction rod 105 is arranged so as to penetrate a central part of the magnetic field coil 120 in a non-contact state relative to the magnetic field coil 120. By this arrangement, the magnetic field coil 120 can generate a magnetic field to act on the super magnetostriction rod 105 in a direction in which the super magnetostriction rod 105 extends. Therefore, an extension/contraction of the super magnetostriction rod 105 can be controlled in a non-contact state from the outside by controlling the magnetic field generated by the magnetic field coil 120, in other words, by controlling a current to be supplied from a current supply device 166 to the magnetic field coil 120 by the control unit 180. The super magnetostrictive element constituting the super magnetostriction rod 105 is formed of an alloy of a rare earth element and iron. For example, $BFe_2$, $DyFe_2$, $SmFe_2$ or the like is known as the alloy.

The loop-shaped rear side permanent magnet 104 and front side permanent magnet 106 are arranged on both ends of the super magnetostriction rod 105, and furthermore, the rear side yoke 103 is disposed adjacent to the rear side permanent magnet 104. The front side yoke 107 is disposed adjacent to the front side permanent magnet 106. The rear side permanent magnet 104 and the front side permanent magnet 106 generate a magnetic field preliminary to the super magnetostriction rod 105, thereby raising a working point of the magnetic field. A super magnetostriction linearity to an intensity of the magnetic field can be improved by this magnetic bias. The permanent magnets 104 and 106 are not essential and may be eliminated from the arrangement. At the same time, the magnets 104 and 106 are not limited to permanent magnets and can be anything that functions as a source for generating a magnetic force.

In the above-constituted moving device 101, there is formed a closed loop magnetic circuit for controlling the extension/contraction of the super magnetostriction rod 105 by the magnetic field acting, e.g., in a direction of the super magnetostriction rod 105→the rear side permanent magnet 104→the rear side yoke 103→the yoke material 121→the front side yoke 107→the front side permanent magnet 106→the super magnetostriction rod 105. The magnetic field can be made opposite in direction to the above in some cases.

More specifically, because of the rear side yoke 103, rear side permanent magnet 104, super magnetostriction rod 105, front side permanent magnet 106, front side yoke 107, magnetic field 120 and yoke material 121, the moving device 101 is constituted as a super magnetostriction actuator which can control the extension/contraction of the super magnetostriction rod 105 in the extension direction of the super magnetostriction rod 105, namely, an axial direction 171 of the application head 100 by the current supplied to the magnetic field coil 120. The front side yoke 107 extends/contracts in the axial direction 171 as well when the super magnetostriction rod 105 extends/contracts in the axial direction 171.

The rotating device 118 is secured with bolts 124 to the rear side of the housing 112. The rotating device 118 using a motor in the embodiment is controlled in the operation by the control unit 180. The rotating device 118 has an output shaft 118*a*, which is coupled via a coupling 119 to one end part of the rear side yoke 103. The coupling 119 transmits a rotational force of the output shaft 118*a* in a circumferential direction 172 to the rear side yoke 103, and moreover holds the rear side yoke 103 movably in the axial direction 171. To the one end side of the rear side yoke 103 is fitted a rear side sleeve 122 slidably in the axial direction 171 and in the arrow direction 172 to the rear side yoke 103. Therefore, the rear side yoke 103 can be rotated inside the housing 112, e.g., in the circumferential direction indicated by the arrow 172 by the rotating device 118, and is supported via the rear side sleeve 122 and a bearing 123 rotatably relative to the housing 112.

The application head 100 further comprises a center shaft 109 which projects from the rear side yoke 103 and extends at the center of the application head 100 along the axial direction 171. The center shaft 109 uses a non-magnetic material in order that it not affect the magnetic circuit of the moving device 101. Since the rear side yoke 103 is rotated by the rotating device 118 as described above, the center shaft 109 can similarly rotate about its axis, i.e., in the direction indicated by the arrow 172. The center shaft 109 is fitted slidably in the axial direction 171 and rotatably in the circumferential direction 172 to each of the loop-shaped rear side permanent magnet 104, super magnetostriction rod 105 and front side permanent magnet 106.

The center shaft 109 extends to one end part of the front side yoke 107 and is coupled to the front side yoke 107 by a pin 110. Therefore, the front side yoke 107 rotates integrally with the center shaft 109 in the same direction. The front side yoke 107, having a front side sleeve 125 fitted thereto, is supported via a bearing 126 rotatably to the housing 112.

The above pin 110 may be a key. The above bearing 126 may be a normal bearing, or a guide member capable of rotating and moving in an axial direction.

There are bias springs 127 and 128 arranged as an example of an urging force generation member between the rear side yoke 103 and the rear side sleeve 122, and between the front side yoke 107 and the front side sleeve 125, respectively. It may be possible under a specific condition to set either one of the springs 127 and 128. These springs 127 and 128 generate a load of pressing the super magnetostriction rod 105 by the rear side yoke 103 and the front side yoke 107 via the rear side permanent magnet 104 and the front side permanent magnet 106. As a result, a compressive stress is applied in the axial direction 171 at all times to the super magnetostriction rod 105, thereby being able to eliminate demerit of the super magnetostrictive element subject to a tensile stress in the event that a repeated stress is generated by the extension/contraction of the super magnetostriction rod 105 in the axial direction 171 caused by the magnetic field coil 120.

The rotational force by the rotating device 116 is transmitted only to the center shaft 109 and the front side yoke 107 by the the moving device 101 as above, without generating a torsional torque to the super magnetostrictive element which is a brittle material.

The discharge member 108 is mounted detachably to one end of the front side yoke 107 by bolts 161 as an example of the fastening member. The T-shaped discharge member 108 has a flange part 1081 attached to one end to be made a mounting part to the front side yoke 107, and a projecting part 1082 integrally molded with the flange part 1081 to project from the flange part 1081. The discharge member 108 is a member for carrying out a discharge operation for the fluid.

The movement groove 134 is formed spirally in a circumferential face 1082*a* of the projecting part 1082, which will be described in detail later.

Since the front side yoke 107 is moved so as to extend/contract in the axial direction 171 by the moving device 101, the discharge member 108 moves simultaneously with the front side yoke 107 in the same direction. Moreover, the discharge member 108 rotates in the circumferential direction 172 via the front side yoke 107 through the rotation of the center shaft 109 in the circumferential direction 172 by the rotating device 118. The discharge member 108 can move in the axial direction 171 and in the circumferential direction 172 at the same time and independently of each other as above.

The storage member 113, for storing or housing the discharge member 108, has a main member 1131, a nozzle member 1132 with a discharge nozzle 116 and a mounting member 1133. As shown in FIG. 2, the main member 1131 has a recess 1134 for storing the projecting part 1082 of the discharge member 108 via a first gap 162 in a diametrical direction of the projecting part 1082 to a circumferential face 1082*a* of the projecting part 1082 and via a second gap 163 in the axial direction of the projecting part 1082 to a discharge end face 1083 of the projecting part 1082. Moreover, the main member 1131 includes a fluid supply passage 115 for supplying the fluid 175 to the first gap 162. The projecting part 1082 is movable in the axial direction 171 inside the recess 1134. The main member 1131 is attached detachably to the housing 112 by bolts 164 as an example of the fastening member. The storage member 113 has a recess 1137 so as to form a space in which the flange part 1081 of the discharge member 108 is freely movable in the axial direction 171 inside the storage member 113 in a state with the storage member 113 attached to the housing 112.

The nozzle member 1132 is a member secured by the mounting member 1133 detachably to an end part of the main member 1131, and has an opposite face 131 for forming the second gap 163 with the discharge end face 1083 when the nozzle member 1132 is attached to the main member 1131. The discharge nozzle 116 projects along the axial direction 171 from the nozzle member 1132. Through the nozzle member 1132 and the discharge nozzle 116 is formed a discharge passage 1135 for discharging the fluid 175 to the outside after being supplied to the first gap 162 and moved to the second gap 163 by the discharge member 108. The discharge passage 1135, which extends along a center axis of the discharge member 108, is opened to the second gap 163.

Neither of the discharge end face 1083 and the opposite face 131 is provided with a structure for controlling the discharge operation of the fluid 175, e.g., a structure formed spirally from the center part of the discharge member 108 to the circumference thereof, or the like.

The mounting member 1133 has a screw part 1136 to be engaged with the main member 1131 and clamps the nozzle member 1132 along with the main member 1131. The mounting member 1133 is screwed at the screw part 1136 to the main member 1131, and thus is detachably connected to the main member 1131.

The fluid 175 is filled in the first gap 162 and the second gap 163 between the main member 1131 and the discharge member 108. Thus an O-ring 150 is attached as a sealing material to the main member 1131 as shown in FIG. 1 so as to prevent the fluid 175 from leaking to the front side yoke 107 through the first gap 162. The first gap 162 and the second gap 163 function as a pump chamber for supplying the fluid 175 to the discharge passage 1135.

The fluid supply device 165 for supplying the fluid is connected to the fluid supply passage 115, which is controlled by the control unit 180.

The movement groove 134 formed in the circumferential face 1082*a* of the projecting part 1082 will now be discussed.

As illustrated in FIG. 2, the movement groove 134 is a groove for moving the fluid present in the first gap 162 to the second gap 163 through the rotation of the discharge member 108 in the circumferential direction 172 is by the rotating device 118. The groove 134 has a function similar to a function of a groove used in a spiral groove dynamic pressure bearing or a screw groove pump. The above movement of the fluid from the first gap 162 to the second gap 163 by the movement groove 134 generates a supply pressure to the fluid 175. The supply pressure is determined by a rotational angular speed, a groove depth, a groove angle, a groove width, a ridge width, and the like of the movement groove 134. According to the embodiment, for instance, 1–2 threads, a groove pitch of 0.5–4 mm, the groove depth of 0.01–1 mm and the groove width of 0.1–3 mm can be adopted. Single-thread, the groove pitch of 1.5 mm, the groove depth of 0.3 mm and the groove width of 1 mm are preferable as one example.

The movement groove 134 is formed in the circumferential face 1082*a* of the projecting part 1082 of the discharge member 108 in the embodiment. However, the position where to form the movement groove is not limited to this and the movement groove 134 may be formed at least in either the circumferential face 1082*a* facing the first gap 162, or a first opposite face 1131*a* opposed to the circumferential face 1082*a* of the main member 1131 of the storage member 113.

As described above, both the motion in the axial direction 171 by the moving device 101, and the motion in the circumferential direction 172 by the rotating device 118 can be applied to the discharge member 108 by the control unit 180 concurrently and independently. Thus, when the fluid is to be discharged to the outside from the discharge passage 1135, the discharge member 108 is rotated in a fluid discharge direction by the rotating device 118 and at the same time, the discharge member 108 is moved in a discharge direction 171*a* along the axial direction 171 by the moving device 101. Also, when the discharge of the fluid from the discharge passage 1135 is to be stopped, the rotating device 118 is made to stop the rotation of the discharge member 108, and moreover the discharge member 108 is moved in a direction 171*b* opposite to the discharge direction 171*a* along the axial direction 171. The movement of the discharge member 108 in the opposite direction 171*b* returns the discharge member 108 in the opposite direction 171*b* to an original position from a position to which the discharge member 108 is moved in the discharge direction 171*a*.

In the present embodiment as described hereinabove, the discharge member 108 is rotated in the fluid discharge direction and also moved in the discharge direction 171*a* when the fluid is to be discharged to the outside from the discharge passage 1135. However, it is possible to discharge the fluid to the outside by an arrangement in which only the discharge member 108 is moved in the discharge direction 171*a*, and the rotation of the discharge member 108 in the fluid discharge direction acts to supply the fluid to the second gap 163.

A displacement detection sensor 129 is installed in the housing 112. The displacement detection sensor 129 is disposed opposite to the flange part 1081 of the discharge member 108 for detecting a displacement of the discharge member 108 in the axial direction 171. The displacement detection sensor 129 is connected to the control unit 180, and thus the control unit 180 obtains a displacement amount of the discharge member 108. The displacement amount can be used as a movement amount of the discharge member 108 in the axial direction 171 at the discharge operation for the fluid, as will be described later, in order to control a discharge amount.

Since an input current applied to the super magnetostrictive element of the super magnetostriction rod 105 is proportional to a displacement at the super magnetostriction rod 105, it is possible to control the positioning of the discharge member 108 in the axial direction 171 even with an open-loop control without installing the above displacement detection sensor 129. However, in the case where the displacement detection sensor 129 is installed, thereby executing feedback control, characteristics of a hysteresis of the super magnetostrictive element can be improved, thus enabling more highly accurate positioning.

The lift device 311 will be described next. The lift device 311 in the embodiment moves the application head 100 up and down in the axial direction 171 along a vertical direction through the control of the control unit 180.

The horizontal moving device 313 moves the supporting member 312 for supporting an object 320 to which the fluid is to be applied from the application head 100, in a horizontal direction orthogonal to the axial direction 171, namely, mutually orthogonal X and Y directions under the control of the control unit 180.

Although the embodiment is constructed so as to move the application head 100 up and down and move the supporting member 312 horizontally, the embodiment is not restricted to this arrangement and may be constructed so that the application head 100 is moved horizontally while the supporting member 312 is moved up and down. In short, operations of the up/down movement and the horizontal movement may be carried out relative to the application head 100 and the supporting member 312.

The control unit 180 will be described below. The control unit 180 controls the rotating device 118, fluid supply device 165, current supply device 166, lift device 311 and horizontal moving device 313, and also controls the discharge of the fluid on the basis of displacement information supplied from the displacement detection sensor 129.

Hereinbelow will be discussed the control executed when the fluid is supplied from the application head 100 to the object 320, which is supported on the supporting member 312, by the rotating device 118, fluid supply device 165, current supply device 166, lift device 311 and horizontal moving device 313.

Figures 3A, 3B, 3C, 3D:
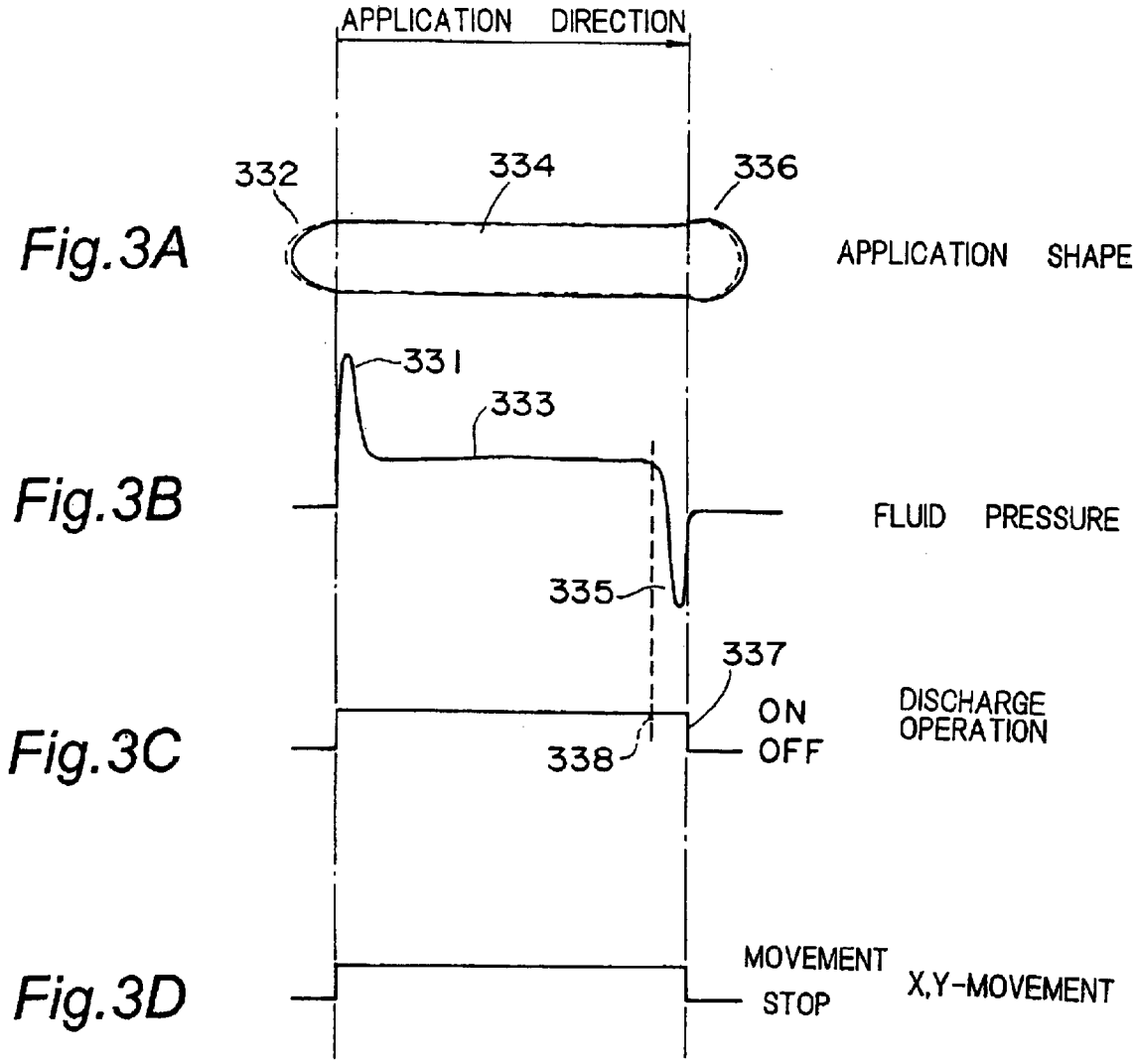
FIGS. 3A, 3B, 3C and 3D are diagrams showing a relation between a state of a fluid applied by the fluid application apparatus in FIG. 1 and the operation of each part in the fluid application apparatus.

In applying the fluid, the control unit 180 drives the lift device 311 in order to lower the application head 100 approximately to a height where a leading end of the discharge nozzle 116 of the application head, i.e., a fluid discharge part is adjacent to the object 320. Then, as described in the description of the application head 100, the control unit 180 causes the rotating device 118 to start rotating the discharge member 108 in the circumferential direction 172 and also causes the moving device 101 to start moving the discharge member 108 in the discharge direction 171*a* as indicated in FIG. 3C. The rotation and the movement of the discharge member 108 are started at the same time in the embodiment. A discharge end face 1083 of the discharge member 108, which is disposed at an initial position 1084 (as shown in FIG. 2), is brought to a discharge position 1085 shown in FIG. 2 by the movement in the discharge direction 171*a*.

By rotating the discharge member 108 in the circumferential direction 172, the fluid 175 present in the first gap 162 is moved to the second gap 163, and consequently a pressure of the fluid 175 in the second gap 163 is increased. The discharge member 108 is further moved in a direction along the axial direction 171 to approach the nozzle member 1132, that is, from the initial position 1084 to the discharge position 1085 in the discharge direction 171*a*. Since the volume of the second gap 163 is decreased through these operations, the pressure of the fluid 175 present in the second gap 163 is temporarily further increased. As a result, a discharge amount of the fluid 175 from the discharge nozzle 116 can be temporarily increased. A state when the pressure is increased is represented by a numeral 331 in FIG. 3B.

The amount of the temporary increase of the discharge amount of the fluid 175 is proportional to a movement amount of the discharge member 108 in the discharge direction 171*a*. In other words, the fluid 175 is not discharged by an amount exceeding the movement amount of the discharge member 108 in the discharge direction 171*a*. Therefore, the arrangement in which the fluid 175 is temporarily increased by moving the discharge member 108 in the discharge direction 171*a* as in the present embodiment enables the fluid 175 to be prevented from being discharged excessively.

In the meantime, the control unit 180 makes the horizontal moving device 313 start moving the supporting member 312 in the X- or Y-direction as shown in FIG. 3D simultaneously with the rotation and the movement operations of the discharge member 108. The movement in the X- or Y-direction is one at least in either the X-direction, or the Y-direction.

Figures 9A, 9B, 9C, 9D:
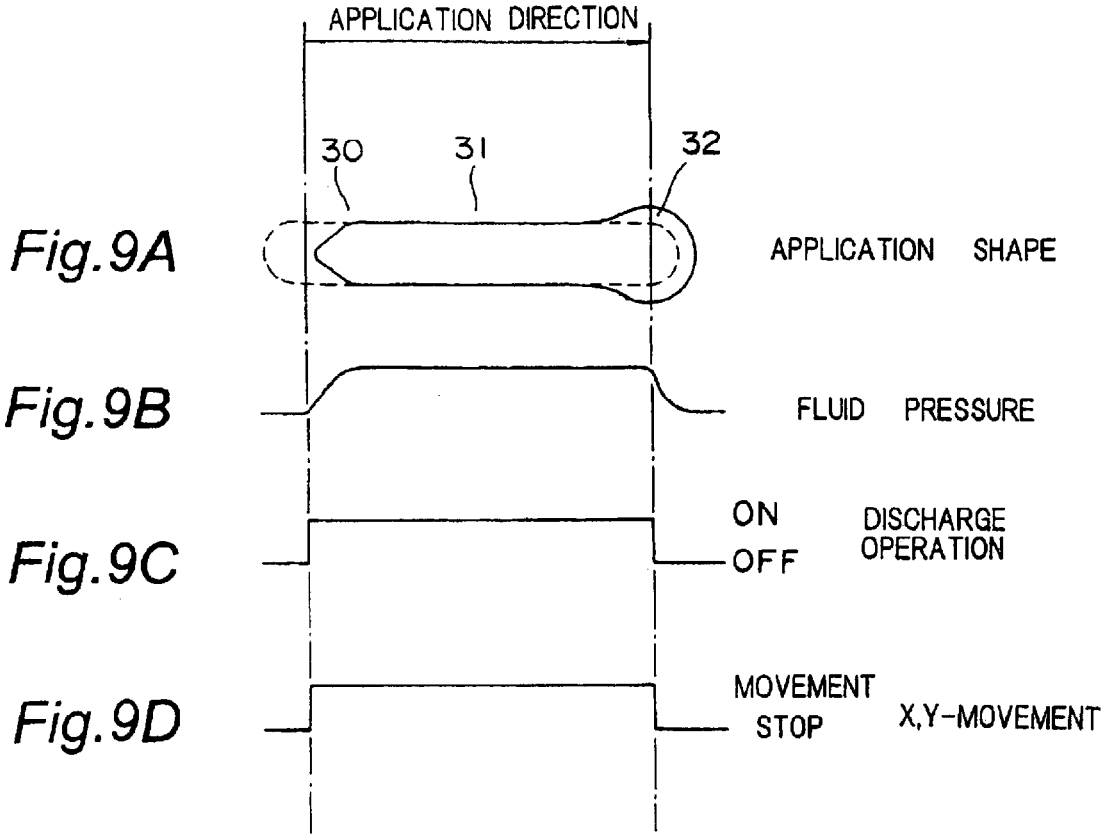
FIGS. 9A, 9B, 9C and 9D are diagrams showing a relation between a state of a fluid applied by the conventional application apparatus and the operation of each part of the application apparatus.

Since the object 320 is moved simultaneously with the temporary increase in the discharge amount of the fluid 175 by the rotation and movement of the discharge member 108, an application amount of the fluid 175 to be applied can be stabilized at the start of discharge 332 as shown in FIG. 3D. More specifically, although the application actually starts with a time delay from the application start instruction at the application start 30 and the application amount is gradually increased as indicated in FIG. 9A in the related art, the application amount is increased at the start of fluid discharge 332 as mentioned hereinabove according to the present embodiment. Therefore, the application state is improved so as to be close to an ideal state indicated by a dotted line in FIG. 3A.

Until the discharge of the fluid 175 from the discharge passage 1135 stops after the start of the discharge, the control unit 180 controls the rotating device 118 in order to rotate the discharge member 168 in the circumferential direction 172, and at the same time, controls the horizontal moving device 313 in order to move the supporting member 312 as above. At this time, the control unit 180 controls the moving device 101 and the rotating device 118 so that the discharge member 108 is kept in the discharge position 1085 without being moved in the axial direction 171 and is rotated at a constant rotational speed in the circumferential direction 172.

Accordingly, the pressure of the fluid 175 at the second gap 163 is made constant or nearly constant by the rotation of the discharge member 108 as represented by reference numeral 333 in FIG. 3B. The fluid 175 is constantly or nearly constantly discharged from the discharge nozzle 1132, that is, applied by a constant or nearly constant amount onto the object 320 as indicated by reference numeral 334 in FIG. 3A.

At a discharge stop time, the control unit 180 makes the rotating device 118 stop rotating the discharge member 108 in the circumferential direction 172, and makes the moving device 101 start moving the discharge member 108 in the opposite direction 171*b* to the discharge direction 171*a* along the axial direction 171 from the discharge position 1085 to the initial position 1084. In the embodiment, the movement of the discharge member 108 is started in the opposite direction 171*b* after the rotation is stopped.

In consequence of the stop of rotation stop and the start of movement of the discharge member 108, as indicated by a reference numeral 335 in FIG. 3B, the volume of the second gap 163 increases, thus the pressure of the fluid 175 present at the second gap 163 is temporarily decreased. As a result, the fluid 175 can be sucked into the discharge nozzle 116. A fall denoted by a reference numeral 337 indicating an end of the discharge operation in FIG. 3C corresponds to a terminal end point of the movement of the discharge member 108 in the axial direction 171 by the moving device 101. As is apparent from the change of the fluid pressure seen in FIG. 3B and the above description, the stop of rotation the discharge member 108 is carried out at a time point before the fall 337, for instance, at a time point 338 indicated by the dotted line in FIGS. 3B and 3C.

Further, simultaneously with stopping movement of the discharge member 108 in the opposite direction 171*b*, the control unit 180 makes the horizontal moving device 313 stop moving the supporting member 312 in the X- or Y-direction.

The application amount of the fluid 175 to be applied can be stabilized at a discharge end part 336 as shown in FIG. 3A. In the related art, the application amount is increased at the discharge end part 32 as shown in FIG. 9A, and also in the present invention, the fluid 175 is possibly discharged even though slightly from the second gap 163 and the discharge passage 1135 if the discharge member 108 is simply stopped rotating in the circumferential direction 172. According to the present embodiment in contrast to the above, a discharge pressure is instantaneously turned negative by moving the discharge member 108 in the opposite direction 171*b*, thus the fluid discharge can be instantaneously stopped. Consequently, the application state can be improved, so that the application state can be close to the ideal state indicated by the dotted line of FIG. 3A.

As described above, at a time point when the application operation from the discharge nozzle 116 to the object 320 ends, the control unit 180 drives the lift device 311 in order to raise the application head 100 so that the discharge nozzle 116 and the object 320 are separated from each other.

At this time, the discharge member 108 can be moved in the opposite direction 171*b* before or simultaneously with the raising the application head 100 by the lift device 311, thereby enabling the fluid 175 to be sucked into the discharge nozzle 116. That is, the fluid 175 at the leading end of the discharge nozzle 116 can be prevented from becoming stringy, or the stringy state is reduced.

The operation in the above fluid application apparatus 300, i.e., fluid application method carried out by the fluid application apparatus 300 will be described below. The fluid application method is executed while being controlled by the control unit 180.

The horizontal moving device 313 is controlled to position the object 320 so that the discharge nozzle 116 of the application head 100 an application region on the object 320 supported by the supporting member 312.

After the positioning, the lift device 311 lowers the application head 100 to bring the leading end of the discharge nozzle 116 close to the object 320, for example, up to 0.05–0.5 mm from the object 320. An operation for applying the fluid 175 is subsequently carried out on the object 320. The application operation is already detailed in the foregoing description on the control unit 180, and therefore will be described briefly here.

At a start time of the fluid discharge, the discharge member 108 is rotated by the rotating device 118 in the circumferential direction 172 and moved by the moving device 101 in the discharge direction 171*a*. This operation enables a large amount of the fluid 175 to be discharged temporarily from the leading end of the discharge nozzle 116, as compared with the case in which the application is executed by driving only the rotating device 118. Simultaneously with the start of the operation of the rotating device 118 and the moving device 101, the horizontal moving device 313 is driven to move the object 320 so that the fluid is applied to the application region. By way of example, a rotation speed of the discharge member 108 by the rotating device 118 is set to 20–200 rpm, and a movement speed and a movement amount in the discharge direction 171*a* of the discharge member 108 by the moving device 101 are set to 2–20 mm/s and 3–30 mm respectively. A movement speed of the object 320 is set to 5–100 mm/s.

Until the fluid discharge ends after the start of the fluid discharge, the fluid is discharged and applied quantitatively by the rotation of the discharge member 108 by the rotating device 118 without driving the moving device 101. The rotation speed of the discharge member 108 at this time is not changed from that at the start of the fluid discharge.

At the end time of the fluid discharge, the rotation of the discharge member 108 by the rotating device 118 is first stopped, and then the discharge member 108 is moved up in the opposite direction 171*b* by the moving device 101 from the discharge position 1085 to the initial position 1084. The movement speed of the discharge member 108 in the opposite direction 171*b* is set to 2–20 mm/s by way of example.

The horizontal moving device 313 is stopped simultaneously when the discharge member 108 ends the upward movement. Since the fluid 175 is pulled into the discharge nozzle 116 because of the movement of the discharge member 108 in the opposite direction 171*b* at the end of the fluid discharge, the fluid is prevented from being extraordinarily applied at the end of the fluid discharge.

Simultaneously with the end of the fluid discharge or after the fluid discharge, the lift device 311 is driven to raise the application head 100, when the application operation at one point of the object ends. Further, the discharge member 108 may be moved in the opposite direction 171*b* before or simultaneously with the upward movement of the application head 100, thereby sucking the fluid 175 into the discharge nozzle 116 in order to prevent or reduce the above-mentioned stringy state.

At present, the fluid application apparatus 300 is preferably used to apply a sealing material for mounting components, etc., for example, an epoxy-based adhesive. Preferably, a viscosity of the adhesive is 10–500 Pas, the rotation speed of the discharge member 108 is 150–200 rpm and the movement speed of the object to be applied 320 is 10–30 mm/s.

The above-described operation is continued until the application to all application spots of the object 320 is completed. The object 320 is transferred to a next process when the fluid is applied to all spots completely, and a next object is carried into the fluid application apparatus 300.

As is already described with reference to FIG. 3A, according to the fluid application apparatus 300 of the embodiment, the application amount of the fluid to be applied can be stabilized over the entire application region including the fluid discharge start part 332 and the fluid discharge end part 336.

The above effect of stabilizing the application amount at the fluid discharge start part 332 and the fluid discharge end part 336 in the fluid application apparatus 300 according to the present embodiment will be described more specifically with reference to the result of experiments.

Figure 7:
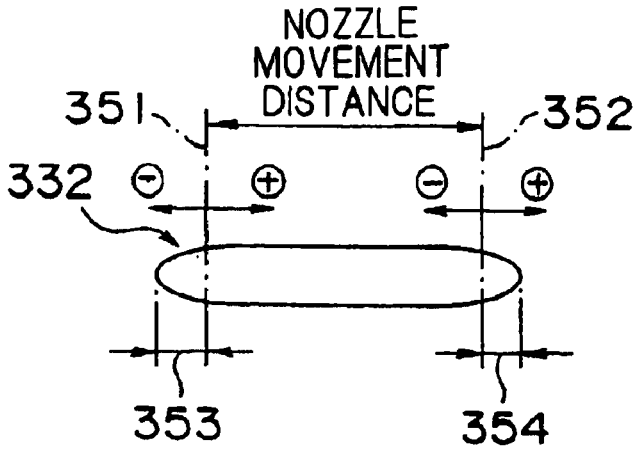
FIG. 7 is a diagram explanatory of a method of judging whether an application state of the fluid is good or not in experiments with the use of a conventional application apparatus and the fluid application apparatus shown in FIG. 1.
Figure 8:
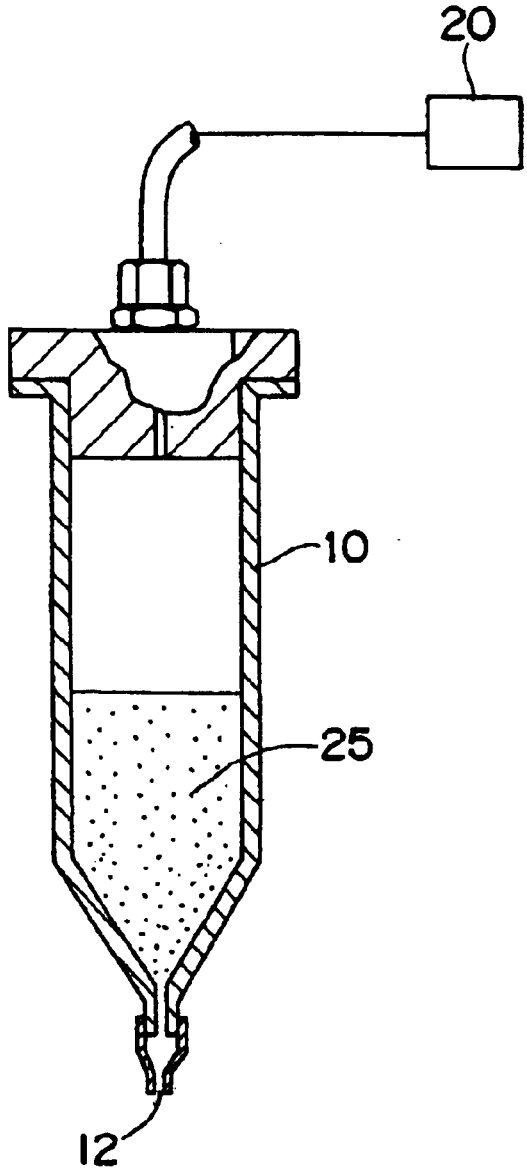
FIG. 8 is a diagram of the conventional application apparatus.

The experiment is carried out under conditions that an epoxy-based adhesive for sealing semiconductor elements is used as the fluid to be applied, which has a viscosity of 30 Pas while a standard value of the rotation speed of the discharge member 108 is 100 rpm, a standard value of the movement speed of the object 320 is 10 mm/s, and an application length is 30 mm. Under the above condition, as indicated in FIG. 7, with the fluid being discharged from the discharge head by the application head, the object 320 and the discharge nozzle are relatively moved from a movement start position 351 to a movement end position 352. At this time, a difference between a start edge position of the fluid and the movement start position 351 at the fluid discharge start part 332 is measured as a start point size 353, and moreover, a difference between a terminal edge position of the fluid and the movement end position 352 at the fluid discharge end part 336 is measured as an end point size 354. The start point size 353 and the end point size 354 are marked with plus and minus symbols to indicate a deviation direction as in FIG. 7. For example, when the start point size 353 at the movement start position 351 is plus, this means that the fluid discharge from the discharge nozzle is delayed with respect to the movement start of the discharge nozzle. On the other hand, when the start point size 353 at the movement start position 351 becomes minus, this means that the fluid is discharged from a time point of the movement start of the discharge nozzle.

The start point size 353 and the end point size 354, and the application amount are measured seven times for each of the conventional application apparatuses and the fluid application apparatus 300 of the embodiment.

The experiment result is that the start point size 353 in the conventional application apparatus is plus 0.220 mm on average and its $3\sigma$($\sigma$: a standard deviation) is 0.347 mm, while the start point size 353 in the present application apparatus 300 is minus 0.132 mm on average and its $3\sigma$ is 0.172 mm. As is understood from the result, although the fluid cannot be discharged at the movement start time of the discharge nozzle in the conventional application apparatus, the fluid discharge is carried-out from the movement start time point of the discharge nozzle in the present application apparatus 300. Additionally, the deviation of the fluid discharge in the fluid discharge of the application apparatus 300 is approximately half in comparison with the conventional apparatus, that is, the fluid discharge is made more stable as compared with the conventional apparatus.

The end point size is plus 0.329 mm on average and its $3\sigma$ is 0.080 mm in the conventional apparatus. On the other hand, the fluid application apparatus 300 of the embodiment has the end point size of plus 0.307 mm and its $3\sigma$ of 0.075 mm. With regards to the end point size, the fluid application apparatus 300 is not much different from the conventional apparatus. However, in terms of the $3\sigma$ in the application amount, the fluid application apparatus 300 of the present embodiment has 0.4 mg whereas the conventional apparatus has 1.2 mg. Therefore, an irregularity in the application amount of the fluid application apparatus 300 is restricted to ⅓ that of the conventional apparatus.

As described earlier, since the discharge member 108 is moved in the opposite direction 171*b* at the fluid discharge end time, the following effect is obtained when the application head 100 is moved up by the lift device 311 in the apparatus 300.

Figure 4:
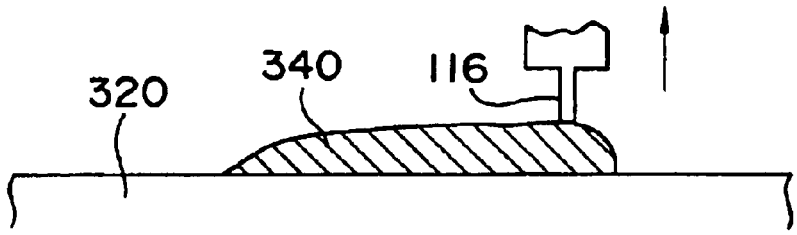
FIG. 4 is a diagram showing a terminal state of an application operation for the fluid.
Figure 5:
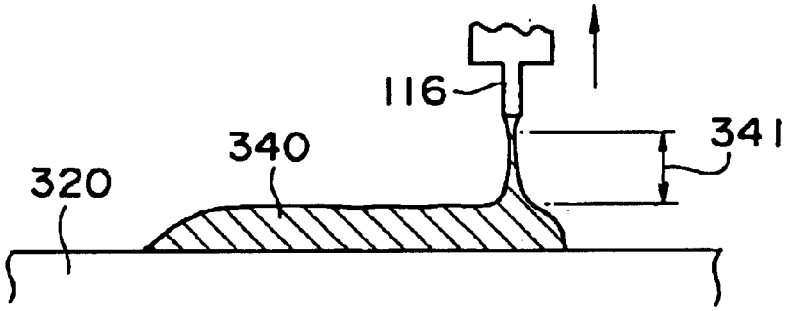
FIG. 5 is a diagram showing a state successive to the state of FIG. 4 when an application nozzle moves up in the related art.

If the application head 100 is simply moved upward without the discharge member 108 being moved in the opposite direction 171*b* at the fluid discharge end time as shown in FIG. 4, the fluid present at the leading end of the discharge nozzle 116 becomes stringy, extends to a length 341 and cuts at a thin part as illustrated in FIG. 5. The fluid of an amount corresponding to the length 341 flows and adds to a fluid 340 applied below the fluid, resulting in an increase of the application amount at the discharge end part 32 as shown in FIG. 9A.

Figure 6:
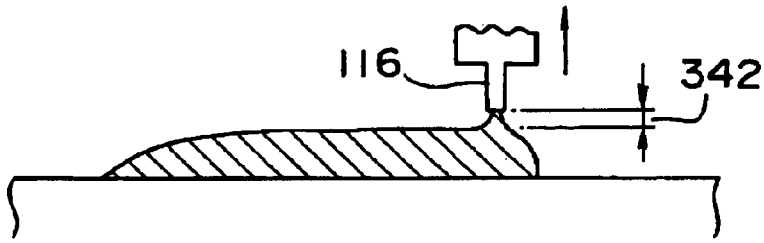
FIG. 6 is a diagram showing a state successive to the state of FIG. 4 when the application head shown in FIG. 1 moves up.

According to the present invention, the discharge member 108 is moved in the opposite direction 171*b* immediately before the fluid discharge end or when the application head 100 is raised by the lift device 311, so that the fluid 175 present at the leading end of the discharge nozzle 116, can be drawn into the discharge nozzle 116. Consequently, a stringy length 342 is made shorter than the length 341 as is clearly shown in FIG. 6, and the increase in the application amount of the fluid 175 at the discharge end part can be suppressed.

As is described hereinabove, according to the fluid application apparatus 300 of the embodiment, the application amount is stabilized by rotating the discharge member 108 in the circumferential direction 172 and moving the discharge member 108 in the axial direction 171. Furthermore, the movement amount of the discharge member 108 in the axial direction 171 can be minutely controlled because the super magnetostrictive element is used as the driving source for the movement. The moving device 101 having the super magnetostrictive element can control the application amount precisely, and contributes to stabilize more the application amount in association with the effect of the controlled movement of the discharge member in the axial direction 171.

Meanwhile, it may be considered possible to finely adjust a discharge timing so as to compensate for the discharge delay even in a system in which the fluid is discharged by air pressure or by the rotation of a screw. However, this type of adjustment is merely a time control without controlling the application amount. The conventional system cannot control both of the discharge timing and the application amount, having the application amount varied more as compared with the present embodiment.

Since the discharge member 108 is rotated in the circumferential direction 172 and moved in the axial direction 171 as above, it is possible to apply a high-visconty fluid at high speeds. Moreover, it becomes possible to discharge the fluid of a considerably minute amount highly accurately by finely controlling the movement amount of the discharge member in the axial direction 171 because the moving device 101, which has the super magnetostrictive element as the driving source, is used to move the discharge member.

When the fluid application apparatus 300 of the present embodiment is employed for a dispenser in the surface mounting field, or used for applying a phosphor of PDPs and CRT displays, a sealing material of liquid crystal panels, etc., the advantage is fully exhibited and the effect becomes enormous.

In the above-described embodiment, the fluid is applied linearly as indicated in FIG. 3A. That is, the horizontal moving device 313 is driven concurrently with the discharge operation of the discharge member 108. However, an application form of the fluid is not limited to the shape shown in FIG. 3A, and the fluid can be applied point by point by separately carrying out the discharge operation by the discharge member 108 and the operation by the horizontal moving device 313. The same effect as in the linear application can be obtained also in the point application.

Although the super magnetostrictive element is used as the moving device 101 in the above embodiment, the moving device is not restricted to the super magnetostrictive element and, for instance, the electro-magnetostrictive element such as a piezoelectric element or the like can be used because a stroke of the discharge member 108 in the axial direction 171 is several tens $\mu$m at most.

Permanent magnets 104 and 106 for bias are used at portions where the magnetic circuit is formed, which is particularly effective when the expansion and contraction of the electro-magnetostrictive element is used for both of the actions at expansion and contraction sides. However, the bias magnets may be eliminated if the expansion/contraction only at the expansion side is considered as more important.

The embodiment adopts the arrangement in which the fluid 175 is supplied to the second gap 163 by rotating the discharge member 108 with the movement groove 134, and the rotating device 118 is provided with the motor therefor. In the case, e.g., without the movement groove 134 being formed, such an arrangement may be constituted wherein the fluid is discharged continuously with the utilization of a fluid supply source at the fluid supply device 165, for example, with the use of air pressure.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims unless they depart therefrom.

What is claimed is:

1. A fluid application method carried out with the use of an application head which includes:

a cylindrical discharge member for carrying out a discharge operation for a fluid to be applied;

a storage member defining a recess for receiving the cylindrical discharge member and a discharge passage extending along a center axis of the cylindrical discharge member, wherein the storage member and the cylindrical discharge member define a first gap at an outer circumferential surface of the cylindrical discharge member, and a second gap at a discharge end face of the cylindrical discharge member, wherein the discharge passage is open to the second gap for discharging fluid supplied to the first gap and moved to the second gap;

a moving device having an electro-magnetostrictive element for moving the cylindrical discharge member along an axial direction thereof so as to control the starting and stopping of the discharge of the fluid through the discharge passage;

a rotating device for rotating the cylindrical discharge member along a circumferential direction of the cylindrical discharge member; and a movement groove formed in at least one of the circumferential surface of the cylindrical discharge member facing the first gap, or an inner peripheral surface of the storage member that opposes the circumferential surface of the cylindrical discharge member for moving the fluid in the first gap to the second gap upon rotation of the cylindrical discharge member by the rotating device, the method comprising:

discharging the fluid through the discharge passage by rotating the cylindrical discharge member, and moving the cylindrical discharge member in a discharge direction along the axial direction thereof to increase a pressure of the fluid present in the second gap in order to temporarily increase the amount of the fluid discharged from the discharge passage.

2. The fluid application method according to claim 1, further comprising:

stopping the rotation of the cylindrical discharge member; and moving the cylindrical discharge member in a direction opposite to the discharge direction in order to suck the fluid into the discharge passage, wherein the cylindrical discharge member is moved in the opposite direction after the rotation of the cylindrical discharge member is stopped.

3. The fluid application method according to claim 2, further comprising:

moving the application head and an object, on which the fluid is to be applied, relative to each other in order to place the object in close proximity to the application head at the start of a fluid discharge operation, wherein the rotation and axial movement of the cylindrical discharge member, in the discharge direction, are started at the start of the fluid discharge operation, and, at the same time, the relative movement of the application head and the object is started in a horizontal direction, and wherein, before the fluid discharge operation is stopped, the rotation of the cylindrical discharge member and the relative movement of the application head and the object are carried out, and, at a stop time of the fluid discharge operation, the rotation of the cylindrical discharge member is stopped, the axial movement of the cylindrical discharge member is stopped, and at the same time, the relative movement of the application head and the object in the horizontal direction is stopped and the application head and the object are relatively moved in a vertical direction to separate the application head from the object.

4. A fluid application method carried out with the use of .an application head which includes:

a cylindrical discharge member for carrying out a discharge operation for a fluid to be applied;

a storage member defining a recess for receiving the cylindrical discharge member and a discharge passage extending along a center axis of the cylindrical discharge member, wherein the storage member and the cylindrical discharge member define a first gap at an outer circumferential surface of the cylindrical discharge member, and a second gap at a discharge end face of the cylindrical discharge member, wherein the discharge passage is open to the second gap for discharging fluid supplied to the first gap and moved to the second gap;

a moving device having an electro-magnetostrictive element for moving the cylindrical discharge member along an axial direction thereof so as to control the starting and stopping of the discharge of the fluid through the discharge passage;

a rotating device for rotating the cylindrical discharge member along a circumferential direction of the cylindrical discharge member; and a movement groove formed in the circumferential surface of the cylindrical discharge member facing the first gap or in an inner peripheral surface of the storage member that opposes the circumferential surface of the cylindrical discharge member for moving the fluid in the first gap to the second gap upon rotation of the cylindrical discharge member by the rotating device, the method comprising:

discharging the fluid through the discharge passage by rotating and axially moving the cylindrical discharge member in a discharge direction;

stopping the rotation of the cylindrical discharge member; and axially moving the cylindrical discharge member in a direction opposite to the discharge direction in order to suck the fluid into the discharge passage, wherein the cylindrical discharge members is moved in the opposite direction after the rotation of the cylindrical discharge members is stopped.

* * * * *